United States Patent [19]

Negishi et al.

[11] Patent Number: 4,523,428

[45] Date of Patent: Jun. 18, 1985

[54] PROCESS FOR MANUFACTURING TEXTURED MULTIFILAMENT YARN HAVING ALTERNATING TWIST

[75] Inventors: Takao Negishi; Teiryo Kojima, both of Otsu; Kazuo Tomiita, Tokyo, all of Japan

[73] Assignee: Toray Industries, Inc., Tokyo, Japan

[21] Appl. No.: 452,998

[22] Filed: Dec. 27, 1982

Related U.S. Application Data

[62] Division of Ser. No. 209,217, Nov. 21, 1980, Pat. No. 4,402,178.

[51] Int. Cl.[3] ..... D02G 1/02; D02G 3/24; D02G 3/26

[52] U.S. Cl. ..... 57/288; 57/205; 57/283; 57/284

[58] Field of Search ..... 57/205, 283, 284, 287, 57/288, 204, 208, 293, 294

[56] References Cited

U.S. PATENT DOCUMENTS

| | | | |
|---|---|---|---|
| 3,698,178 | 10/1972 | Iwaoka et al. | 57/287 |
| 3,914,930 | 10/1975 | Jenkins | 57/283 X |
| 3,932,986 | 1/1976 | Kosaka et al. | 57/283 |
| 3,977,173 | 8/1976 | Kosaka et al. | 57/205 |
| 3,978,647 | 9/1976 | Kosaka et al. | 57/205 |
| 4,335,572 | 6/1982 | Pope | 57/283 |

*Primary Examiner*—John Petrakes
*Attorney, Agent, or Firm*—Austin R. Miller

[57] ABSTRACT

A specially designed multifilament textured yarn has alternating twists therein. A woven or knitted fabric manufactured from the yarn has a handling similar to that obtained by a hard twist yarn or a true twist yarn and provides pattern with a heather like feeling.

In the yarn, S-twist yarn portions and Z-twist yarn portions are alternatingly distributed along the length of the yarn but the non-twisted portion is substantially not included in the yarn. Either S-twist yarn portions or Z-twist yarn portions have a compact twist yarn structure, and the other portions have a bulky twist yarn structure.

16 Claims, 11 Drawing Figures

FIG. 1.
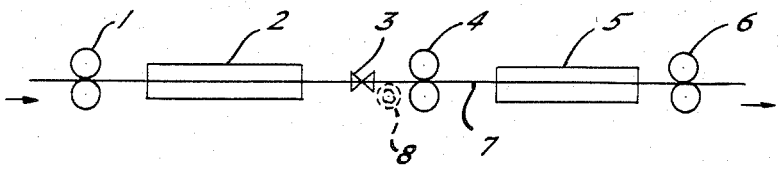
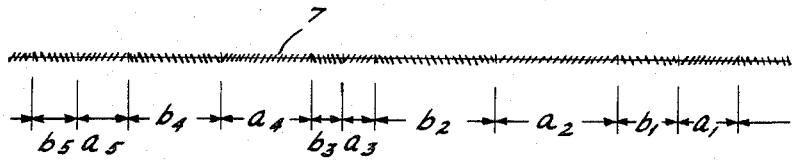
FIG. 2.
FIG. 3.
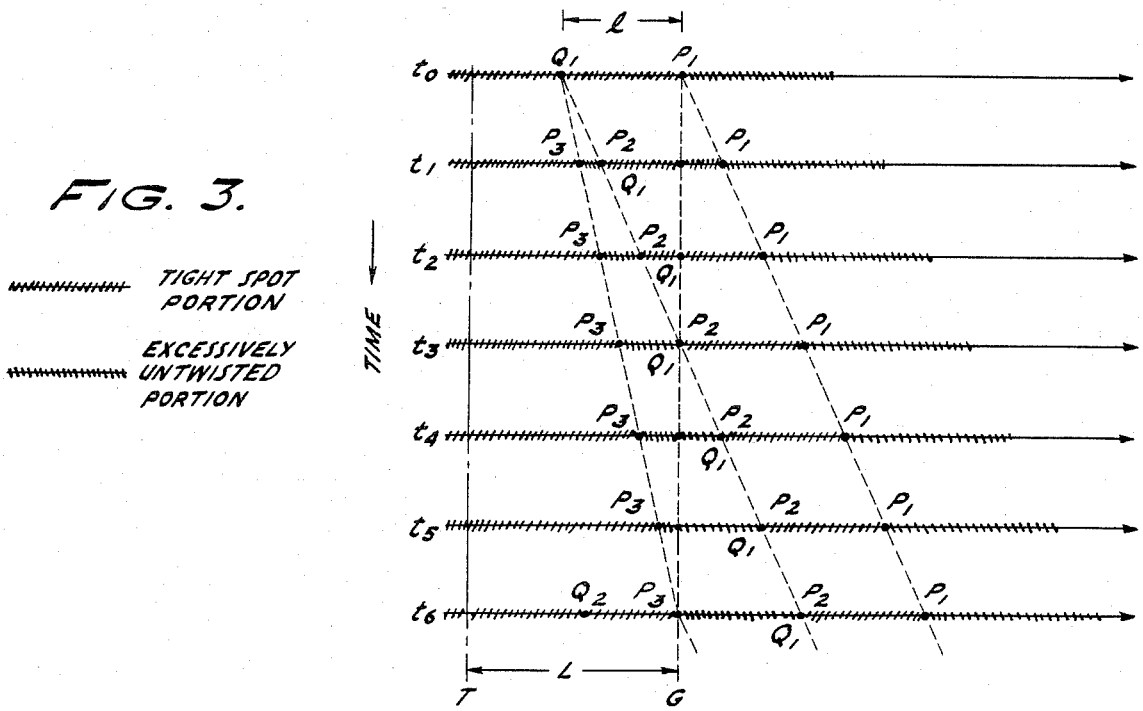
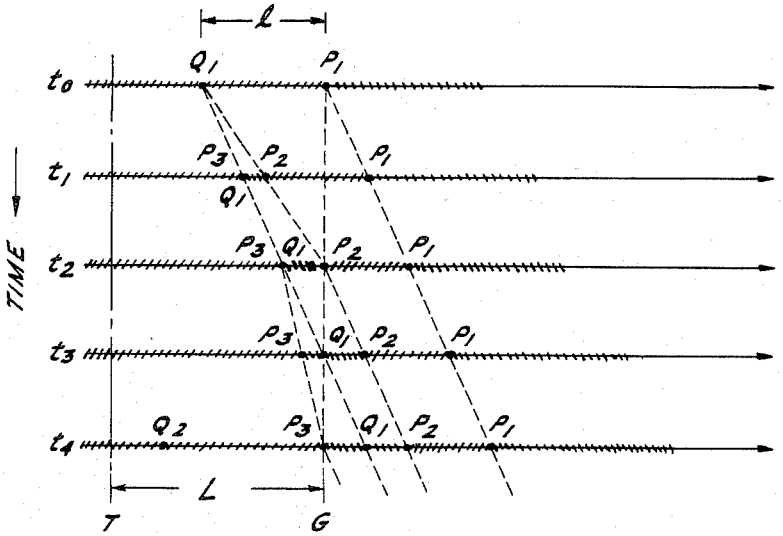
FIG. 4.

FIG. 8.
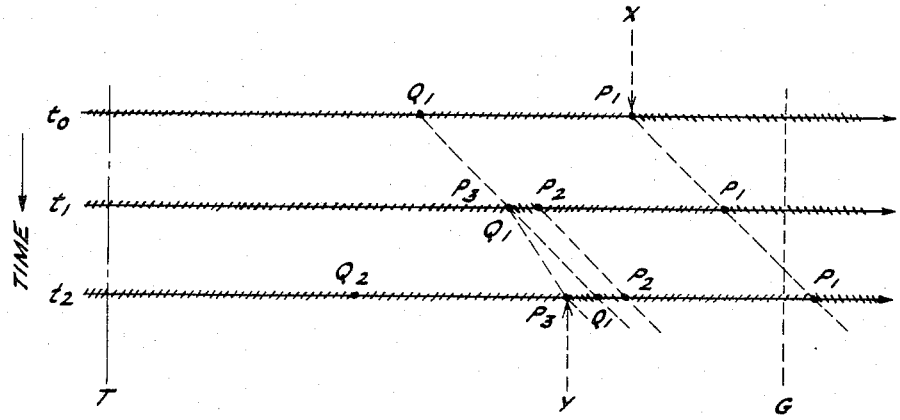
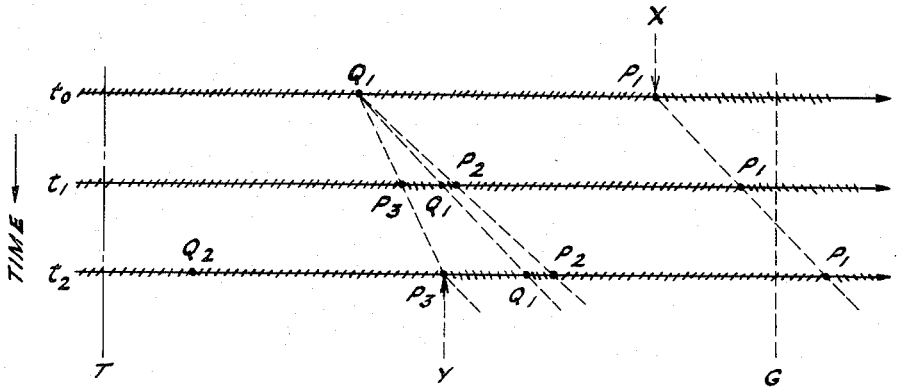
FIG. 9.
FIG. 10.
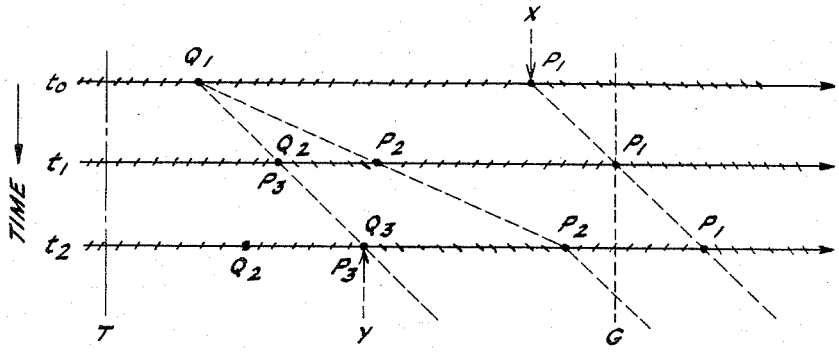
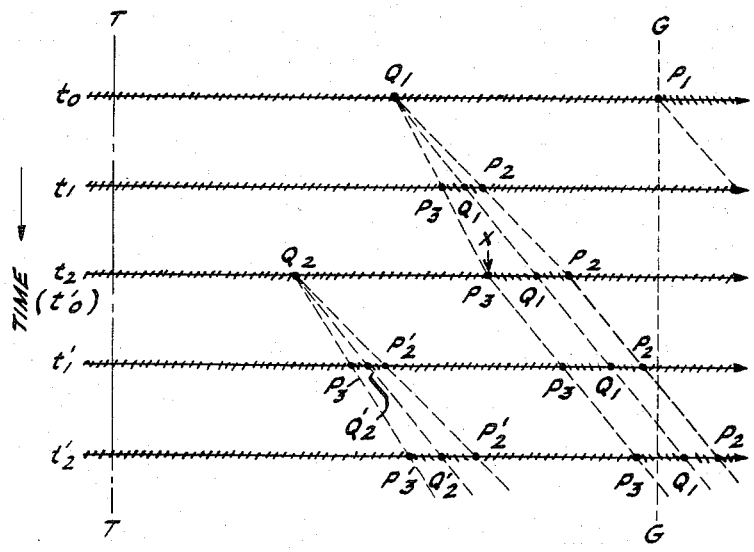
FIG. 11.

PROCESS FOR MANUFACTURING TEXTURED MULTIFILAMENT YARN HAVING ALTERNATING TWIST

This is a division, of application Ser. No. 209,217, filed Nov. 21, 1980 now U.S. Pat. No. 4,462,178.

FIELD TO WHICH THE PRESENT INVENTION RELATES

The present invention relates to a specially designed multifilament textured yarn, by which a woven or knitted fabric having a handling similar to that obtained by a hard twist yarn or a true twist yarn and providing pattern with a heather-like appearance. More specifically, the present invention relates to a novel multifilament textured yarn wherein S-twist yarn portions and Z-twist yarn portions are alternatingly distributed along the length of the yarn, and either S-twist yarn portions or Z-twist yarn portions have a compact twist yarn structure and the other portions have a bulky twist yarn structure. Due to the effects of mixing the bulky portions and compacted portions, or thick portions and thin portions, a highly valuable product having the superior hand mentioned above can be obtained.

In the present invention, so called compact undetwisted portions, which are obtained by retaining the twist yarn structure, in a false twist imparting region while being subjected to false twisting, in the yarn after the false twisting operation, are utilized as the above-mentioned compact twist yarn structure. In addition, so called bulky over detwisted portions, which are obtained by untwisting a yarn in the false twist imparting region while being subjected to false twisting to an extent exceeding the twist density in the yarn, are utilized as the above-mentioned bulky twist yarn structure. The yarn structure in alternatingly twisted conditions comprising the compact undetwisted portions and the detwisted portions results in an effect similar to that obtained by a hard twist yarn or a true twist yarn, and the difference in configuration between the undetwisted portions and the excessively detwisted portions results in a heather-like appearance and the hand associated therewith.

The term "an undetwisted portion" utilized in this specification means that a yarn is tightly twisted for a certain length as if a series of so called tight spots continuously occur.

BACKGROUND OF THE INVENTION

Conventionally known are various methods by which undetwisted portions and excessively detwisted portions are alternatingly formed in a multifilament yarn by means of falst twisting. For example, Japanese Patent Publications No. 25065/75, No. 225/76 and No. 42662/76 disclose methods wherein a drawn multifilament yarn made of polyester fibers or polyamide fibers are false twisted by means of a spindle type false twisting device having a twisting peg therein at an excessively high temperature so that the fibers constituting the yarn are partially cohered to each other. Further in Japanese Patent Laid-open No. 143746/76 and No. 143749/76, and Japanese Patent Publications No. 15188/78 and No. 30818/78, methods are disclosed wherein a drawn multifilament yarn is false twisted by means of a false twisting device utilizing a turbulent fluid jet under a high overfeed.

In addition, methods are known in which a multifilament is positively subjected to a non-uniform treatment while it is being false twisted. For example, methods in which contacting conditions between a multifilament yarn and a heating device are varied are described in Japanese Patent Laid-open No. 66928/74, No. 15017/76 and No. 8119/77. Methods in which twists transmitted from a false twisting device toward a heating device are varied are described in Japanese Patent Publication No. 34016/76, and Japanese Patent Laid-open No. 554/74 and No. 121546/75. Japanese Patent Publication No. 8414/74, and Japanese Patent Laid-open No. 108353/74 and No. 61745/78 disclose methods in which the number of twists generated in a multifilament yarn by means of a false twisting device is varied. Methods in which the speed of a multifilament passing through a false twisting device is varied are described in Japanese Patent Laid-open No. 92337/74 and 92354/74. In Japanese Patent Laid-open Nos. 66722/77, 81749/78 and 101654/74, methods in which a mutlifilament yarn is irregularly false twisted along the length of the yarn are described.

All the above-described prior arts relate to a method for manufacturing an alternatingly twisted yarn by means of false twisting, however, they have a defect in that the average twist density over the entire yarn cannot be high because of the following reasons. (1) A large amount of non-twisted portions which are similar to those in a usual false twisted textured yarn are formed in addition to definite S-twist portions and Z-twist portions. (2) Relatively long non-twisted portions are formed between the S-twist portions and Z-twist portions. (3) The twist density in an undetwisted portion or an over detwisted portion is not uniform but is high at the center thereof and low at the ends thereof. (4) The twist densities in undetwisted portions or in over detwisted portions are varied. (5) The ratio of the length of undetwisted portions to the entire yarn length cannot be high. Furthermore, the alternatingly twisted yarns obtained in accordance with teachings described in the above-described prior arts have defects in that, although the yarn has twists in the same direction as that of the false twisting, it is slightly detwisted so that undetwisted portions are formed in which false twisted crimps appear and their compactness is lost; and that, although the yarn has twists in the opposite direction as that of the false twisting, the cohesion between the fibers constituting the yarn is so strong that over detwisted portions are formed in which the false twisted crimps do not appear and their bulkiness is lost, and accordingly in the yarns, difference between the configurations of the undetwisted portions and the over detwisted portions cannot be clearly distinguished from each other except by their twist directions.

It should be noted that the yarn of the present invention explained above cannot be manufactured easily in accordance with the above explained prior arts. More specifically, according to the above-explained prior arts, any alternatingly twisted yarn which is preferable as the object of the present invention cannot be obtained. In fact, some attempts have been made in order to eliminate the defects inherent in the above-explained prior arts, however, the attempts have not met the requirements. This is because, all the developments, which have been achieved are considered to be directed to improve the external factors with respect to formation of an alternatingly twisted yarn, e.g., the false twisting texturing conditions, such as the number of false twists, the tension in the yarn while it is treated or the heating temperature, the characteristics of the supply yarn which has to be textured, or the construction of the false twisting device but they are not directed to the mechanism itself by which an alternatingly twisted yarn is formed.

The present invention is based on research of the mechanism for forming an alternatingly twisted yarn because the mechanism is of importance.

OBJECT OF THE INVENTION

The main object of the present invention is to provide a specially designed multifilament textured yarn by which a woven or knitted fabric having a hand similar to that obtained by a hard twist yarn or a true twist yarn and providing patterns with a heather-like appearance, especially a relatively slight and uniformly distributed heather like appearance, and the present invention also relates to a process for manufacturing the same.

BRIEF DESCRIPTION OF THE DRAWINGS

FIG. 1 is a diagrammatical elevational view illustrating an example of a process of the present invention for manufacturing a specially designed alternatingly twisted yarn;

FIG. 2 is a model view illustrating a structure of a specially designed alternatingly twisted yarn according to the present invention; and FIGS. 3 through 11 are model views illustrating yarn forming mechanisms through which specially designed alternatingly twisted yarn according to the present invention are obtained.

DETAILED DESCRIPTION OF THE INVENTION

Figure 5:
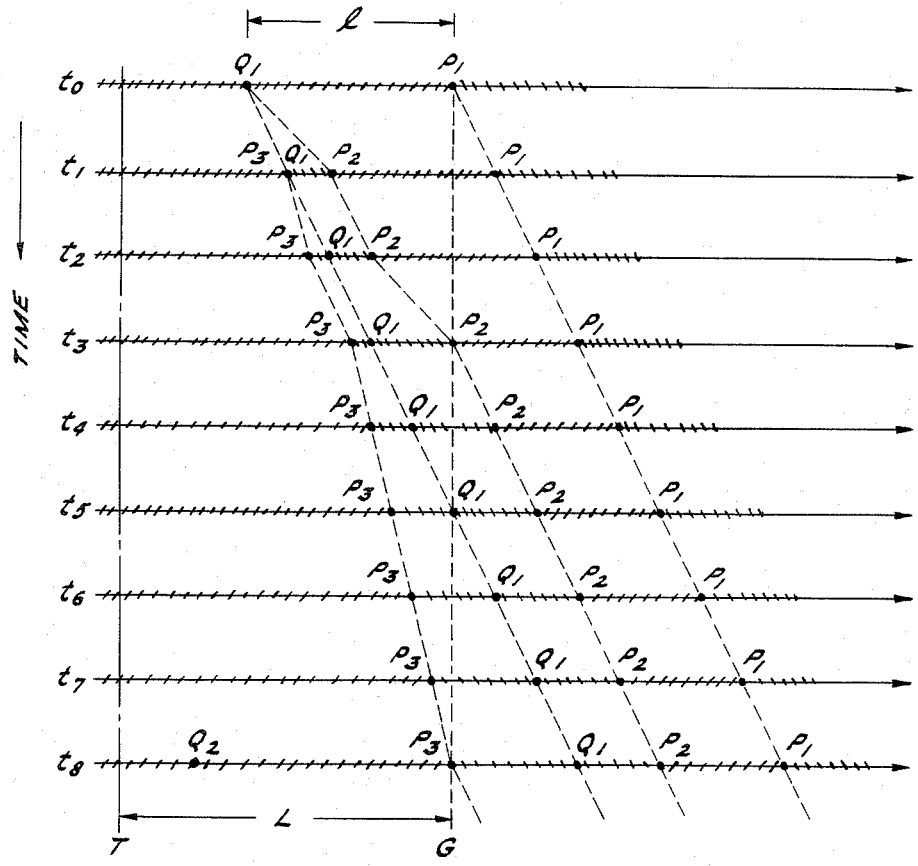

In short, in the present invention, so called undetwisted portions, which are obtained by retaining the twist structure, which has been in a yarn in a false twist imparting region while being subjected to false twisting are utilized as a compact twist yarn structure; and so called over detwisted portions, which are obtained by detwisting a yarn in a false twist imparting region while being subjected to false twisting to an extent exceeding the twist density in the yarn, are utilized as a bulky twist yarn structure; and thus obtained alternatingly twisted yarn comprising the undetwisted portions and the over detwisted portions can result in a woven or knitted fabric having a hand similar to that obtained by a hard twist yarn or a true twist yarn due to the high twist density and a heather-like appearance due to the difference in the configurations between the compact undetwisted portions and the over detwisted portions.

The following reasons should be pointed out as to why such an alternatingly twisted yarn as that of the present invention has not conventionally been obtained.

(1) It is very important to enhance the twist densities of both the undetwisted portions and the excessively detwisted portions to obtain a hand similar to that obtained by a hard twist yarn or a true twist yarn, i.e., to enhance the twist density of the undetwisted portions and the ratio of their length to the entire length of the yarn. There is a tendency that, if the twist density of a yarn located at the twist imparting region while being false twisted is enhanced, generation of undetwisted portions is decreased; and this tendency is disadvantageous to a yarn similar to that of the present invention. Although some attempts have been made in order to increase the generation of undetwisted portions, however, such attempts deteriorate the hand of a woven or knitted fabric obtained from the resulting yarn.

(2) In order to obtain a relatively slight heather-like appearance and the hand associated therewith, a distinctive difference in the configurations of the undetwisted portions and the over detwisted portions is necessary, since such appearance and hand are obtained only on the basis of the difference in the yarn structures of the undetwisted portions and the over detwisted portions because both the portions are constructed with the same fibers having the same denier and the same filament number. To comply with such a necessity, it is very important that the compactness of the undetwisted portions be increased, and that the bulkiness of the over detwisted portions be enhanced. However, in conventional false twisting methods, where both the undetwisted portions and the over detwisted portions are subjected to the same false twisting, if the undetwisted portions are subjected to high false twisting in order to enhance the bulkiness of the over detwisted portions, then the generation of the undetwisted portions is degraded because of the reason already described in item (1). Accordingly, it has been difficult to form such a difference in configurations.

(3) With respect to the heather-like appearance and hand associated therewith, patterns are important and depend closely on the length, number and amount of the undetwisted portions. According to conventional methods, it was difficult to obtain a suitable heather-like appearance, because the length of the undetwisted portions was short and the amount thereof was small.

(4) A high tensile strength is required to achieve the object of the present invention. This is because, the undetwisted portions and the over detwisted portions in the yarn must not be decreased by offsetting their twists against each other when they are subjected to high tension in the yarn while the yarn is formed into a woven or knitted fabric.

However, according to conventional methods, there is no method except that fibers are cohered to each other so as to enhance the tensile strength. In order to achieve the object of the present invention, the supply yarns, the false twisting devices, the texturing conditions, the obtained yarns and the fabrics obtained by weaving the yarns taking the above-explained problems inherent to the conventional methods into consideration were carefully studied. As a result, it has been found that a yarn which has been compared with a conventional yarn must satisfy the following requirements in order to achieve the object of the present invention. (1) The yarn does not have an uneveness in dyeability along the length of the yarn. (2) Filaments constituting the yarn have only very little cohesion therein. (3) The twist density in the undetwisted portions is enhanced, the ratio of the length thereof to the entire yarn length is increased, and the individual length thereof is elongated. (4) The tensile strength of the yarn is enhanced.

In addition, it also has been found that it is preferable to adopt the following technical measures in order to achieve the object of the present invention.

First, the most important requirement is that the yarn does not have any uneveness in dyeability along the length thereof, and the requirement can be satisfied when false twisting is carried out under stationary conditions.

Second, the cohesion between the filaments constituting the yarn must be as little as possible. This requirement will be satisfied by not only appropriately selecting the false twisting conditions but also by utilizing an undrawn yarn, which has a wide temperature range wherein the filaments are intermediately cohered, as a supply yarn, and selecting the molecular orientation in the undrawn supply yarn if necessary.

In the present invention, conjugated fibers comprising at least two kinds of materials which are different in their melting points may be utilized, and at least two kinds of fibers which are different in their melting points and which are combined with each other may be utilized. In these cases, polyester fibers may be effectively utilized.

Third, a friction type false twisting device must be used as a false twisting device, because such a twisting device imparts only small deflections except for twists into the yarn and does not create substantial ballooning in the yarn.

Based on the above-described requirements, that constitute main technical concepts of the present invention, the basic construction of the present invention is as follows.

A textured multifilament yarn made of a thermoplastic synthetic material and having alternating twists therein, which comprises:

(a) all the constituent filaments constituting the textured yarn having crimps of twist configurations obtained through imparting twists in the yarn and heat setting the twists over substantially the entire portions of the filaments;

(b) the textured yarn alternatingly having S-twist yarn portions and Z-twist yarn portions, which are distributed along the length of the yarn and which vary in their lengths, either the S-twist yarn portions or the Z-twist yarn portions being designated as A and the other being designated as B;

(c) substantially in all the A's existing in the yarn, and in substantially the entire portion of each A, substantially all the constitutent filaments have a crimp configuration consistent with twist structure of the yarn and have a compact structure, and the yarn has a substantially uniform twist density along the length of the yarn and has a substantially uniform thickness along the length of the yarn;

(d) substantially in all the B's existing in the yarn, and in substantially the entire portion of each B, substantially all the crimp configurations in the constituent filaments are not consistent with twist structure of the yarn but appear therefrom to form a bulky structure, and the yarn has a substantially uniform twist density along the length of the yarn and has a substantially uniform thickness along the length of the yarn;

(e) the yarn is substantially free from any non-twist yarn portions; and (f) A and B are different from each other in their configurations and are substantially the same in their constituent filaments.

More specifically, the characteristic of the present invention is that the resultant yarn is a multifilament yarn which is false twisted in such manner that the yarn alternatingly has compact twist yarn portions and bulky twist yarn portions along the length of the yarn, the twist directions of which are opposite to each other and the length of which are varied irregularly.

The term "compact twist yarn portion" described above means a yarn portion which has twists and in which the crimp configuration of the filaments is consistent with the twist structure of the yarn. In other words, when a multifilament yarn having no twists therein is subjected to twisting and then is heat set, such a compact twist yarn portion can be obtained. In the present invention, such a compactly twisted yarn portion is mainly obtained by retaining the twisted yarn structure, which has been in the yarn at a false twisting region while the yarn is false twisted, in the yarn which is obtained after the false twisting operation.

The term "bulky twist yarn portion" described above means a yarn portion which has twists and in which the crimp configuration of the filaments appears. In short, such bulky twist yarn portion can be obtained when a multifilament yarn which has no twists but has crimps therein is subjected to a twisting operation. In the present invention, such a bulky twist yarn portion is mainly adopted by an over detwisted yarn which is obtained by detwisting a yarn at a false twisting region under a false twisting operation to an extent greater than, the twist density of the yarn.

The term "the yarn alternatingly has compact twist yarn portions and bulky twist yarn portions" described above means that the yarn does not substantially include any portions which are not included in either the compact undetwisted portions or the bulky detwisted portions. However, strictly speaking, there must be non-twisted portions, which do not belong to either the compact undetwisted portions or the bulky over detwist portions, at the boundaries between the compact untwisted portions and the bulky over detwisted portions. Such non-twisted portions do not have substantial length and usually do not exceed 1 mm.

Furthermore, a yarn according to the present invention is characterized in that the ratio of the length of the compact undetwisted portions to the entire length of the yarn is at least 10%, and that the sum of the squares of the length (in mm) of the compact twist yarn portions is at least 3,000 per one meter length of the yarn. In the yarn of the present invention, wherein undetwisted portions are distributed along the length of the false twisted yarn, and the amount of the undetwisted portions must be sufficient to achieve the object of the present invention. At this point, the relationship between the patterns with a heather-like appearance and the hand associated therewith in woven or knitted fabric and the amount of the undetwisted portions must be taken into consideration. The patterns are also related to the lengths of the undetwisted portions as well as the taste of the consumer. However, in general, if the amount of the undetwisted portions is small, only narrow stripe-like patterns appear on an obtained woven fabric; if the amount of the undetwisted portions exceeds 10%, the probability in that undetwisted portions adjacent to each other become high and the width of the stripes increases, and therefore, the patterns clearly appear.

As mentioned above, strictly speaking, the lengths and the amount of the undetwisted portions are simultaneously related to the patterns with a heather-like appearance. For example, when the length of the undetwisted portions is about 5 mm, uneven patterns appear but patterns with a heather-like appearance cannot be obtained. If the area of the undetwisted portions is about 10 mm, the patterns are elongated from the uneven patterns. If the area of the undetwisted portions increases, i.e., equal to or more than 30%, patterns with a heather-like appearance develop. Incidentally, when the length of the undetwisted portions becomes about 40 mm, patterns with a heather-like appearance develop if there are about two undetwisted portions per one meter, i.e., about 8% of the total length. According to various tests, when the sum of the squares of the lengths (in mm) of the undetwisted portions exceeds 3000 per one meter length of the yarn, patterns with the desired heather-like appearance can be observed.

The yarn according to the present invention has an additional characteristic in that it has a twist density (Turn/m) of at least $1.9\times10^3\sqrt{\rho/D}$ over substantial portions of the length of the yarn, wherein $\rho$ is a specific gravity of the filaments and D is the denier number of the yarn. In other words, the yarn according to the present invention has a characteristic similar to that of a twisted yarn. More specifically, if a usual multifilament yarn or a false twisted yarn resulting therefrom is twisted, and if the relationship between the twist density and the hand is researched, a characteristic inherent to a twisted yarn can be recognized when the twist density exceeds a value of $1.9\times10^3\sqrt{\rho/D}$ Turn/m.

It is preferable for a yarn according to the present invention to have a tensile strength of at least 0.3 g/denier. The tensile strength of the yarn relates to the deformation of the yarn during a process wherein the yarn is formed into a woven fabric. It is preferable that the yarn have a high tensile strength in order to prevent deformation of the yarn and that the yarn is subjected to the process under low tension. If a yarn is subjected to the process under a tension of less than 0.3 g/denier, the operability of the process and the quality of the obtained woven fabric will deteriorate, and accordingly, a tensile strength of at least 0.3 g/denier is necessary. If a yarn is utilized after it is additionally twisted or sized so as to enhance the tensile strength, the original yarn is not required to have such a high tensile strength.

If a yarn has a tensile strength of at least 0.3 g/denier as described above, after the yarn is stretch treated while being delivered between a pair of yarn feed rollers at a yarn speed of 200 m/min under a tension of 0.3 g/denier, at least a part of compact twist yarn portions remain, and preferably 10% relative to the entire yarn length remain.

When, in a yarn according to the present invention, the outer diameter of the bulky detwisted yarn portions is larger than the outer diameter of the compact undetwisted yarn portions by at least 10%, patterns with a heather-like appearance are clearly visible in a woven fabric resulting therefrom.

In a yarn of the present invention, if the twist densities in the compact undetwisted portions and the bulky detwisted portions are higher, they are preferred. However, the maximum degree of the twist densities is limited by the manner in which the devices are operated.

In order to obtain patterns with a slight heather-like appearance and the hand associated therewith, it is preferable that the compactness of the undetwisted portions is enhanced and the bulkiness of the over detwisted portions is also enhanced. As described above, the compactness of the undetwisted portions can be obtained by retaining the twist structure in a yarn while being false twisted in a twist imparting region. Contrary to this, where the bulkiness of over detwisted portions obtained by increasing the crimps after cohesion between the constituent filaments is made as small as possible, crimps imparted to the constitutent filaments are made to appear. In this case, it should be noted that the effect of the crimps must be large enough to exceed the negative effect resulting from twists. The twist density in a twist imparting region while a yarn is false twisted must be at least $17500\sqrt{\rho/D}$ Turn/m in order to obtain clear patterns with a heather-like appearance in a woven or knitted fabric.

In conventional false twisting wherein a twist spindle is mainly used, unless high cohesion takes place, the twist density in the undetwisted portions is remarkably lower than that in the false twisting region, and the difference between the twist densities is caused by the fact that the false twisted portions are untwisted. If such untwisting takes place, the structure of the undetwisted portions is partly damaged and sometimes split lines are formed in the twisted lines. As a result, the compactness and the tensile strength of the undetwisted portions may be deteriorated. Such a tendency may be enhanced when the twist density in a twist imparting region of the false twisting is high, and as a result of such tendency, the undetwisted portions may be cut into short portions, and accordingly, the length thereof may become short, and therefore, the total length thereof also may become short. Furthermore, this tendency results in a defect in that the twist density of the over detwisted portions cannot be enhanced.

According to a process of the present invention for manufacturing a yarn, the twist density of a yarn located in a twist imparting region for false twisting can be retained in undetwisted portions without decreasing the density, and if false twisting is carried out under a high twist density, the total length of undetwisted portions with high twist density becomes remarkably long, and a yarn having over detwisted portions with high twist density can be obtained.

It is preferable that the following features be included in the yarn in order to obtain a yarn with an enhanced twist density. The twist structure of a yarn in a twist imparting region for false twisting is retained so as to form compact undetwisted portions and form bulky excessively detwisted portions and not form non-twisted portions as described above. When a yarn, in a twist imparting region for false twisting, or undetwisted portions, after the yarn is false twisted, are detwisted, the entire twist density is not gradually decreased but only a part thereof is detwisted. The twist substantially remains at a constant level and the length thereof is gradually shortened. The portions which are detwisted are changed into over detwisted portions by absorbing the twists which depend on the twist density of the yarn before being detwisted. To achieve these features, it is preferable that a yarn substantially does not have an uneveness in dyeability along the length of the yarn and that filaments constituting the yarn are almost not cohered to each other or the degree of the cohesion is so weak that filaments can be split without being cut, as would be the case if the filaments cohered to each other.

Accordingly, when a yarn of the present invention is further twisted, the following properties generally appear. When the yarn is further twisted in a direction the same as that of the twists in the undetwisted portions, the undetwisted portions are unchanged and the twist density of the over detwisted portions is decreased. Contrary to this, when the yarn is further twisted in a direction the same as that of the twists in the over detwisted portions, the undetwisted portions become shortened while the twist density thereof is kept unchanged and the over detwisted portions are elongated while the twist density thereof is kept unchanged.

Utilizing the above-explained properties of the yarn according to the present invention, the characteristics of the yarn according to the present invention can also be recognized. More specifically, the yarn according to the present invention is first further twisted in a direction the same as that of the over detwisted portions so that the area of the undetwisted portions is adjusted, and then, the yarn is further twisted in a direction the same as that of the twists in the undetwisted portions so that the twist density of the undetwisted portions is adjusted to a value (Turn/m) of $1.9\times10^3\sqrt{\rho/\overline{D}}$ which is a minimum value for achieving the twist effect as described above. The total length of the undetwisted portions and the twist effect are compared with each other, and the existence of the undetwisted portions can be seen if the amount of the undetwisted portions exceeds 10%.

It should be pointed out that with respect to the yarn according to the present invention which has a total twist of zero, the following requirements are compatible. (1) The lower limit of the undetwisted portions above which limit patterns with a heather-like appearance clearly visible is $17500\sqrt{\rho/\overline{D}}$ Turn/m. (2) The lower limit of the over detwisted portions above which limit the twist effect can be recognized is $1.9\times10^3\sqrt{\rho/\overline{D}}$ Turn/m. (3) The ratio of the total length of the undetwisted portions to the entire length of the yarn must be more than 10% and the ratio of the total length of the over detwisted portions to the entire length of the yarn must be less than 90%.

The minimum requirements and some optional features regarding the basic construction of the yarn according to the present invention have been explained above.

With respect to the field to which the present invention originally relates and in which hand similar to a true twist yarn is intended, as already partly explained herebefore, the twist density in undetwisted portions, the twist density in the over detwisted portions and the ratio of the length of the undetwisted portions to that of the over detwisted portions are of importance. It is obvious that if the twist densities are higher, the effect on the hand due to the twist yarn becomes higher. However, to create the remarkable effect on the hand by means of the effect of the twist it is necessary that the twist density in the undetwisted portions is at least $17500\sqrt{\rho/\overline{D}}$ Turn/m, and the ratio of the length of the undetwisted portions to the entire yarn length is at least 30% the twist density over the substantially all portions along the length of the yarn is at least $7500\sqrt{\rho/\overline{D}}$ Turn/m. With regard to a yarn having a total twist of zero, all the requirements can be simultaneously satisfied.

As the false twisting number during the false twisting is high, patterns with a heather-like appearance become clear, and if the twist density at the false twisted region is at least $22500\sqrt{\rho/\overline{D}}$ Turn/m, the patterns can visually be recognized. In this case, the twist density in the undetwisted portions is approximately equal to that at the false twisted region (strictly speaking, in fact the former is slightly smaller than the latter, however, the difference can be disregarded), and due to false twisting with this twist density, crimps appear in the filaments in the over detwisted portions.

In a yarn having a total twist of zero, if the undetwisted portions have the above-described twist density and they occupy a length of more than 30% in the entire yarn, the twist density of the over detwisted portions becomes equal to or more than a value of $9.5\times10^3\sqrt{\rho/\overline{D}}$ Turn/m, and a yarn which has such a twist density generally belongs to a field having a hand obtained by a hard twist yarn rather than another field having a handling obtained by a usual twist yarn.

According to the present invention, further characteristic patterns with a heather-like appearance can be obtained in connection with the length of the undetwisted portions. The length of the undetwisted portions is, in general, determined by the various conditions for false twisting and can be varied by changing the conditions. If the sum of the squares of the length (mm) of the undetwisted portions per one meter of the yarn is at least 3000, more preferably at least 5000, very splended patterns with a heather-like appearance and the hand associated therewith can be obtained in combination with the above-explained twist effect. This is because, if the above requirement is satisfied, the length of the individual undetwisted portions is made long.

In order to obtain a specially designed false twisted yarn according to the present invention, it is one of the preferable technical features that an undrawn yarn is used as a supply yarn and is fed to a friction type false twisting device so that the yarn is subjected to false twisting under a stationary condition while it is being drawn. In this case, the draw ratio is selected at a value equal to or less than the natural draw ratio of the undrawn yarn. Any friction type false twisting device may be used, however, it is preferable that the friction surface of the friction type false twisting device move in a direction intersecting with the yarn moving direction at an acute angle so that the yarn is subjected to the twisting operation simultaneously with the yarn delivering operation of the friction surface. In addition, the yarn passage, especially a yarn passage located upstream from the false twisting device, or at least adjacent to the false twisting device, is made substantially stationary so that ballooning of the yarn is substantially prevented, and the yarn is drawn and simultaneously or sequentially false twisted. The false twist number is in a range between a minimum value, which is a little bit higher than $17500\sqrt{\rho/\overline{D}}$ Turn/m, and a maximum value, which is slightly smaller than the value of the false twisting number which is used to obtain a usual false twisted yarn, i.e., a so called woolly yarn. As the false twisting temperature increases, the effect becomes more pronounced. However, it is necessary to avoid such an excessively high temperature that filaments constituting the yarn and cohered to each other cannot be separated from each other unless the cohered filaments are broken.

Furthermore, in the present invention, it is preferable that the yarn guide which is usually disposed downstream of a false twisting device in a conventional friction false twisting texturing machine, for example at a position of about 15 mm downstream from the lowermost friction disk in a friction type false twisting device of multiple friction disk type, be removed to achieve more effective texturing conditions. By appropriately selecting the false twisting conditions, such as the removal of the yarn guide, the temperature condition of the false twisting heater, the false twist number and the draw ratio during the draw-false twisting, the twist densities of the undetwisted portions and the over detwisted portions and the lengths thereof can be varied to an extent which cannot be obtained through conventional methods.

The false twist number must be at least $17500\sqrt{\rho/\overline{D}}$ Turn/m as described above to produce a yarn having a characteristics similar to that of a true twist yarn, and it must be at least $22500\sqrt{\rho/\overline{D}}$ Turn/m to produce a yarn having a characteristics similar to that of a hard twist yarn. The preferred temperature of the false twist heater is between about 210° and 240° C. when a multifilament yarn made of polyester fibers is treated and the preferred temperature is between about 175° and 190° C. when a multifilament yarn made of polyamide fibers, for example nylon 6, is treated. Of course, it is possible to obtain a specially designed false twisted yarn in a temperature region which is different from that mentioned above, and in that case, the temperature is set in accordance with the supply yarn, the desired textured yarn and the remaining texturing conditions.

To obtain a specially designed alternatingly twisted yarn of the present invention, it is very important that another mechanism be used for forming an alternatingly twisted yarn, which mechanism is different from that utilized in conventional process for making an alternating twisted yarn. The formation of an alternatingly twisted yarn through false twisting partly depends on the false twisting device and conditions upstream thereof. However, the formation per se of an alternating twisted yarn is effected downstream of the false twisting device. When a yarn located downstream of a false twisting device in a conventional method is observed, various conditions occur wherein undetwisted portions are formed, over detwisted portions are formed and non-twisted portions are formed. Undetwisted portions are formed through various methods which are classified into two cases, i.e., (1) a case wherein undetwisted portions which are being formed are rotated in a false twisting direction at a rotating speed depending upon the twist density, and (2) a case wherein they are rotated at a rotating speed lower than that of case (1) or are not rotated at all. In the second case, the twist number upstream of the false twisting device is lower. The formation of the over detwisted portions is followed by the increase of the twist number the upstream of said false twisting device, and the non-twisted portions are formed as a transient phenomenon or are formed successively between the undetwisted portions and the excessively detwisted portions.

Contrary to this, when a position just below the false twisting device and a position further downstream of the position just below the false twisting device are observed, no undetwisted portions are newly formed at these positions. When undetwisted portions are formed by rotation of the yarn downstream of the false twisting device, the over detwisted portions are successively formed because the downstream part of the undetwisted portions are untwisted or because the non-twisted portions which located downstream of the undetwisted portions are twisted. In some cases, the non-twisted portions are formed by offsetting the twists, both of the undetwisted portions and the over detwisted portions.

In conventional methods, there were various mechanisms for forming alternatingly twisted yarn as described above. However, the alternatingly obtained twisted yarns had many defects as described above.

Contrary to this, the present invention is based on the knowledge that the formation of undetwisted portions just downstream of the false twisting device which can be occasionally observed in the above-described conventional methods is most effective for forming an alternatingly twisted yarn of the present invention, and according to the present invention, it is provided that such a formation is generally continuous, and the twist condition of the undetwisted portion with rotation is brought to a condition similar to a false twisting condition upstream of the false twisting device. In other words, a condition wherein the false twist imparted region transmitted downstream of the false twisting device is continuous. As a result of the application of such condition, the front end of the false twist imparted region located downstream of the false twisting device is rotated, and the rotating portion untwists both the rear portion of the undetwisted portion which has been previously formed and the front end portion so that excessively detwisted portions are successively formed, and so that the front end of the false twist imparted region is moved downstream. The rotation of the front end of the false twist imparted region is stopped when it is held by means of delivery roller, when it contacts with a yarn guide or the like, or when the torque imparted by means of the false twisting device cannot be transmitted. Although the rotation of the front end of the false twist imparted region is stopped, the false twisting device continues to impart torque to the yarn, and therefore, a new detwisting point is created between the front end of the false twist imparted region and the false twisting device. The new detwisting point becomes a new front end of a new false twist imparted region, and accordingly, the above-mentioned phenomenon is repeated. Thus the undetwisted portions and the over detwisted portions, which are alternatingly distributed along the yarn, form an alternatingly twisted yarn. Under the above-described mechanism for forming an alternatingly twisted yarn, virtually no non-twisted portions are formed.

As described above, the main characteristics of a mechanism for forming an alternatingly twisted yarn according to the present invention are that, at least at a location just downstream of the false twisting device, a false twist imparting condition is always taking place, and that the rotation of the front end of the false twist imparted region is necessarily stopped by being held by means of a delivery roller, by being contacted with a guide or the like, or because the rotational force imparted by the false twisting device cannot be transmitted.

Other conditions under which the mechanism for forming an alternatingly twisted yarn of the present invention having the above-explained two characteristics can be achieved, can be determined by taking some matters which will be described later into consideration.

According to the present invention, there are three types of characteristic mechanisms for forming alternatingly twisted yarns based on the methods for stopping the rotation of the front end of the false twist imparted region, and the mechanisms respectively provide characteristic yarn according to the present invention.

In the first type of mechanism, the front end is positively engaged with a member for preventing the transmission of the rotation of the yarn downstream of the false twisting device, and at the same time, the number of over detwisted portion, which is generated between the false twisting device and the engaging member, is always one or less than one. The specially designed alternatingly twisted yarn of the present invention is formed by always retaining a false twist imparting condition at the location just downstream of the false twisting device and by preventing the transmission of the rotation of the yarn downstream so that an over detwisted portion equal to or less than one is always formed between the false twisting device and the engaging member. All various front ends of false twist imparted regions, which are generated as time passes, are made to arrive at the engaging member, such as the delivery roller or the guide, where the rotation of the front ends are stopped.

The above-explained first type will now be described in detail with reference to the accompanying drawings. In FIG. 1, an example of a process for manufacturing a specially designed alternatingly twisted yarn of the present invention is illustrated. A pair of feed rollers 1 feed a supply yarn to a pair of first delivery rollers 4 through a first heater device 2 and a false twisting device 3 which imparts twists into the supply yarn, and the twists imparted by means of the false twisting device 3 run back along the yarn to the heater device 2 where the twists are heat set. A second heater device 5 and a pair of second delivery rollers 6 are optionally disposed downstream of the first delivery rollers 4. Of course, in some cases, the second heater device 5 and the second delivery rollers 6 may be omitted.

The member for preventing the transmission of the rotation of the yarn to the downstream may be the first delivery rollers 4, or another engaging member 8 may be disposed at a location between the false twisting device 3 and the first delivery rollers 4 as illustrated by the broken lines. When such additional member is disposed, the member may be of a stationary type. However, it is preferable that a rotational member, for example a rotating guide which rotates as the engaged yarn moves, is used because such a member is effective for preventing the rotation of the yarn and has a low resistance against the movement of the yarn. A combination of a plurality of members may be utilized as the engaging member 8.

The false twisting device 3 imparts a rotational force to the yarn, and therefore, the yarn located downstream of the false twisting device also has a tendency to rotate in a direction the same as that of the false twisting. Accordingly, it is probable that the yarn located downstream of the false twisting device is rotated and retains the false twist imparting condition while the false twists are not detwisted. Such a false twist imparting condition, i.e., undetwisted condition, may receive a detwisting operation while the yarn is treated in the successive processes. It is preferable that in a yarn according to the present invention, when its undetwisted portions are subjected to a detwisting operation, the entire twist density thereof is not gradually decreased but only a part of the undetwisted portion is untwisted, and the twist density in the undetwisted portion is substantially unchanged and the length thereof is gradually shortened, and the portions which have been untwisted absorb a lot of twists and change into over detwisted portions. This property is utilized in the present invention. To achieve such a property concerning detwisting, it is preferable that the undetwisted portions have a coherently high compact portion with twist and high torsional rigidity, and once they are detwisted, they lose their cohesion and decrease their torsion rigidity. Such a requirement will be satisfied by, for example an appropriate fusing, i.e., a part of or all the fusing in the undetwisted portions may be removed when they are subjected to detwisting. If a heating temperature is selected taking the material of the supply yarn and the material and quantity of the finishing, such as oil, into consideration, such fusing can be obtained.

In a process according to the present invention, an engaging member, such as the delivery roller or guide, for preventing the transmission of the rotation of the yarn to downstream is specially arranged at a location downstream from the false twisting device.

FIGS. 3, 4, 5 and 6 are model views illustrating mechanisms for forming alternatingly twisted yarns of this type as time elapses from $t_0$ to $t_1$, $t_2 \ldots$, in these figures, T denotes a stationary false twisting point; G, stationary point for preventing rotation by means of the engaging member; P, a boundary between the undetwisted portion and the over detwisted portion; and Q, a point where detwisting occurs. The length between the false twisting point T and the rotation preventing point G is denoted by L; $\alpha$ denotes the twist density in the undetwisted portion; and $\beta$ denotes the twist density in the over detwisted portion which is in a torque balanced condition with the undetwisted portion. In FIGS. 3, 4, 5 and 6, a condition is assumed that at time $t_0$ the front end $P_1$ of the false twist imparted region arrives at point G. Under this condition, downstream of the point $P_1$ the over detwisted portion is located, and the upstream of the point $P_1$ is under an undetwisted condition since the point $P_1$ is located within the false twisting imparting region. The rotational force is applied to the yarn at point T, and since at the point $P_1$, which is located at the point G at time $t_0$, cannot be rotated, untwisting occurs at an undetermined point $Q_1$ located between the point T and the point G.

Thereafter, the point $P_1$ and the point $Q_1$ are moved downstream. The portion which has been subjected to detwisting changes to the over detwisted condition and the torque therein is balanced, both ends of the over detwisted portion are denoted by $P_2$ and $P_3$. The portion between the points $P_1$ and $P_2$ moves downward while it retains an original over detwisted portion, and the portion between the points $P_2$ and $P_3$ moves downstream while its length increases.

The point $P_3$ moves downstream as the front end of a new false twist imparted region and arrives at point G (at time $t_6$ in FIG. 3; time $t_4$ in FIG. 4; time $t_8$ in FIG. 5; and time $t_3$ in FIG. 6), then a condition similar to that at time $t_0$ appears. A new undetermined untwisting point $Q_2$ is formed and procedures similar to those described above are repeated.

It should be noted that under the above-explained conditions and in general, the total twist in both a yarn portion which is being treated and a yarn portion which is successive to the former yarn portion is constant and unchanged. The total twist in the yarn portion located upstream of the point T is constant if the false twisting is effected while stationary. In addition, the total twist in the yarn portion located downstream of the point $P_1$ is unchanged and constant since the yarn portion has already been treated.

Accordingly, the total twist between the point T and the point $P_1$ is constant. More specifically, The total twist between the point $T$ and the point $P_1$ $$= \overline{TG} \cdot \alpha \text{ (at time } t_0\text{)}$$

$$= \overline{TG} \cdot \alpha - P_2P_3 \cdot \beta + P_1P_2 \cdot \alpha \text{ (at time } t_6 \text{ in FIG. 3; at time } t_4 \text{ in FIG. 4; at time } t_8 \text{ in FIG. 5; and at time } t_3 \text{ in FIG. 6)}$$

Accordingly, the following equation is obtained.

$$-\overline{P_2P_3} \cdot \beta + \overline{P_1P_2} \cdot \alpha = 0$$

Therefore, the equation (1) is obtained.

$$\overline{P_1P_2} : \overline{P_2P_3} = \beta : \alpha \qquad (1)$$

The equation (1) thus obtained means that the ratio between the length $\overline{P_1P_2}$ of the undetwisted portion and the length $\overline{P_2P_3}$ of the over detwisted portion which is formed at a location upstream and adjacent thereto is determined by the twist densities and is constant.

A further explanation will now be described in detail with reference to FIGS. 3 and 4. In FIG. 3, a procedure wherein untwisting takes place at only point $P_3$ is illustrated, and the over detwisted portion between $P_2$ and $P_3$ is moved downstream while the length thereof is increased upstream. If it is assumed that the detwisting occurs at a point $Q_1$ where the distance $\overline{Q_1P_1}$ is equal to l, at time $t_6$ the equation (4) is satisfied:

$$\overline{P_1P_2}=l \tag{4}$$

Utilizing the equations (1) and (4), the following equation is obtained.

$$\overline{P_2P_3}=l\cdot\alpha/\beta$$

In FIG. 4, originally the point $P_2$ is given priority to be untwisted, the over detwisted portion between $P_2$ and $P_3$ is moved downstream while the length thereof is increased downstream. However, after the time $t_2$ when the point $P_2$ arrives at the point G, detwisting cannot occur at point $P_2$ but takes place at the point $P_3$, in other words, the length of the over detwisted portion is increased upstream, and the following equation is obtained.

$$\begin{aligned}&\text{The number of twists between the points } T \text{ and } P_1\\ &= \overline{TG}\cdot\alpha \text{ (at time } t_0)\\ &= \overline{TP_3}\cdot\alpha - \overline{P_2P_3}\cdot\beta + \overline{P_1P_2}\cdot\alpha \text{ (at time } t_2)\\ &= (\overline{TG} - \overline{P_2P_3})\cdot\alpha - \overline{P_2P_3}\cdot\beta + \overline{P_1P_2}\cdot\alpha\\ &\quad\text{(at time } t_2)\end{aligned}$$

Therefore, the equation (2) is obtained.

$$\overline{P_1P_2}\cdot\alpha=\overline{P_2P_3}\cdot(\alpha+\beta) \tag{2}$$

If it is assumed that the detwisting is commenced at time $t_0$ at a point $Q_1$ where the distance between $Q_1$ and $P_1$ is equal to l, at time $t_2$, following equation is satisfied.

$$l=\overline{Q_1P_1}=\overline{P_3P_1}=\overline{P_1P_2}+\overline{P_2P_3},$$

accordingly, the equation (3) is obtained.

$$\overline{P_2P_3}=l-\overline{P_1P_2} \tag{3}$$

Substituting the equation (3) into equation (2), $$\overline{P_1P_2}\cdot\alpha=(l-\overline{P_1P_2})(\alpha+\beta),$$

and therefore, the equation (5) is obtained.

$$\overline{P_1P_2}=l(\alpha+\beta)/(2\alpha+\beta) \tag{5}$$

Incidentally, at time $t_4$, the following equation is satisfied.

$$\overline{P_1P_2}=\overline{P_1P_2} \text{ at time } t_2=l(\alpha+\beta)/(2\alpha+\beta)$$

Utilizing the above-explained equation (1), $$\overline{P_2P_3}=\frac{l\cdot\alpha(\alpha+\beta)}{(2\alpha+\beta)}$$

As explained above, if a member G for preventing the downstream transmission of the rotation in a yarn is utilized, the point $P_3$ does not move downstream across the point G as illustrated in FIGS. 3 and 4, and at the same time the length of the undetwisted portion $\overline{P_1P_2}$ can be controlled. More specifically, in the case illustrated in FIG. 3, as described in the equation (4), $\overline{P_1P_2}=l$, and In the case illustrated in FIG. 4, as described in the equation (5), $$P_1P_2=l(\alpha+\beta)/(2\alpha+\beta).$$

In an actual process, both cases illustrated in FIGS. 3 and 4 may occur, and besides, a case which is located at the intermediate of the cases illustrated in FIGS. 3 and 4 may also take place. In other words, before point $P_2$ arrives at point G, detwisting may occur alternatingly at point $P_2$ and point $P_3$ (FIG. 5) or simultaneously at both points $P_2$ and $P_3$ (FIG. 6). However, in any case, after point $P_2$ has arrived at point G, detwisting occurs only at point $P_3$. Accordingly, when the detwisting point $Q_1$ is formed at a point which satisfies $\overline{GQ_1}=l$ and point $P_3$ advances to point G, the length $\overline{P_1P_2}$ of the formed undetwisted portion satisfies the following equation.

$$l(\alpha+\beta)/(2\alpha+\beta)\leqq\overline{P_1P_2}\leqq l$$

Since it is possible that the point $Q_1$ may be formed at any point between the points T and G, l satisfies the following equation.

$$0<l<L$$

Accordingly, $0<\overline{P_1P_2}<L$ is probable. In other words, an over detwisted portion which has a length longer than the length L between the points T and G cannot be formed.

Under the above-explained mechanisms for forming alternatingly twisted yarns of the present invention, as mentioned above, since the occurrence of the detwisting point Q may take place at a point between the points T and G at a relatively uniform probability, the lengths of the undetwisted portions and the over detwisted portions are distributed along an approximate rectangular shape rather than a normal distribution, and there is great variation in the lengths. The above-described mechanisms are suitable for obtaining alternatingly detwisted yarns which result in patterns with a uniform heather-like appearance.

When a process according to the present invention is carried out with an engaging member contacting only with yarn downstream of the false twisting device and the engaging member does not function well to prevent the downstream transmission of the rotation of the yarn, the mechanisms for forming alternatingly twisted yarns which were explained above with reference to FIGS. 3, 4, 5 and 6 cannot be achieved. Therefore, such an engaging member is not suitable, and a careful consideration concerning the engaging member should be made. In conclusion, even if an engaging member is used, the engaging member does not serve as a member for preventing the rotation of a yarn according to the present invention when it includes one or both of the following problems.

a. The location where the member is disposed is inappropriate.

b. The member has a very small function for preventing the rotation of the yarn, though the location thereof is adequate, and accordingly, in fact the member does not prevent the transmission of the rotation of the yarn, and as a result, the point Q occurs after the point $P_1$ or $P_3$ is transmitted across the point G.

Under such a mechanism for forming alternatingly twisted yarn, the relationships expressed in the above-described equations do not occur.

In the most preferable embodiment of the process for manufacturing a specially designed alternatingly twisted yarn according to the present invention, a thermoplastic synthetic multifilament yarn is subjected to false twisting by means of a false twisting device, and after the yarn is passed through the false twisting device, the yarn is retained in a false twist imparted condition at a location at least adjacent to the false twisting device, the multifilament yarn is engaged with a member for preventing transmission of the rotation of the yarn downstream of the false twisting device, wherein the member is arranged at such a location that the number of the over detwisted portion, which are generated between the false twisting device and the member for preventing the transmission of the rotation of the yarn is always at most one. According to this embodiment, when a detwisting point $Q_1$ is formed and a front end $P_3$ of the false twist imparted region is formed, only after the point $P_3$ arrives at the point G, a new detwisting point $Q_2$ is generated. More specifically if the distance L between the points T and G is set relatively short, the generation of a new $Q_2$ before the point $P_3$ arrives at the point G can be prevented from occurring. When a yarn is treated, the length of the undetwisted portions are distributed between zero and L as explained above. If the above-explained embodiment is applied to an actual commercial process wherein a number of yarns are simultaneously manufactured, the distribution of the lengths of the compact undetwisted portions can be made uniform between the yarns processed in different treating units.

A model view of a yarn according to the present invention is illustrated in FIG. 2, wherein if the length $a_i$, denoting the length of either the undetwisted portion or the over detwisted portion, is long, the corresponding length $b_i$ is also long; and if the former $a_i$ is short, correspondingly the latter $b_i$ is also short. On the other hand, between the portions except for the corresponding portions $a_i$ and $b_i$, there is no predetermined relationship. Accordingly, the length which is the sum of $a_i$ and $b_i$ distributes randomly, when a woven fabric is manufactured from such a yarn, the woven fabric can provide patterns which are uniformly distributed and have a slight heather like appearance and the hand associated therewith.

Since a yarn of the present invention is obtained through false twisting, the structure of the present yarn is characterized in that the yarn is a multifilament yarn and has false twisted crimps therein, and the Z-twist portion (or S-twist portion) is a compact twist yarn portion wherein the crimp configuration of the filaments is consistent with the twist structure of the yarn, and the S-twist portion (or Z-twist portion) is a bulky twist yarn portion wherein crimp configuration of the filaments appear in the twist structure of the yarn. As to which portion of the S- or Z-portion may be used as a compact or bulky twist yarn portion, this can be selected by setting the false twisting direction at will, and the above explained relationships expressed in the equations can be applied to the portions.

Figure 6:
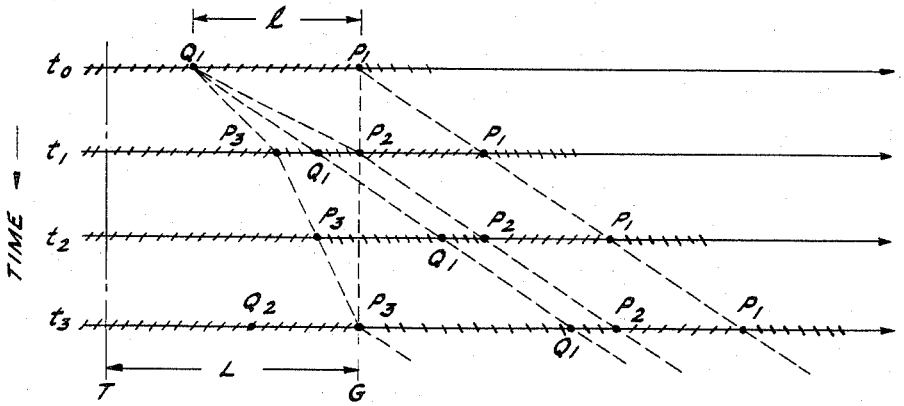

In addition to (1) a case illustrated in FIG. 3 wherein the point $P_3$ is given priority to commence detwisting or (2) a case illustrated in FIG. 4 wherein the point $P_2$ is given priority to commence detwisting, there is (3) a case illustrated in FIG. 6 wherein detwisting simultaneously occurs at the points $P_3$ and $P_2$, and (4) a case illustrated in FIG. 5 wherein detwisting alternatingly takes place at the points $P_3$ and $P_2$. In either case, if the front end $P_1$ of the false twist imparted region arrives at the point G so that an detwisting point $Q_1$ is formed, and then a new front end $P_3$ of a new false twist imparted region arrives at the point G so that a new detwisting point $Q_2$ is formed, the length $\overline{P_1P_2}$ of the undetwisted portion formed between the points $P_1$ and $P_2$ and the length $\overline{P_2P_3}$ of the over detwisted portion formed between the points $P_2$ and $P_3$ always satisfy the equation (1).

As described above, a specially designed alternatingly twisted yarn of the present invention has: the length of undetwisted portions $\overline{P_1P_2}$ formed when the front end $P_3$ of the false twist imparted region arrives at the point G; and the length of an over detwisted portion $\overline{P_2P_3}$ formed adjacent to and upstream of the undetwisted portion. The lengths $\overline{P_1P_2}$ and $\overline{P_2P_3}$ satisfy the equation (1); however the length of the over detwisted portion does not have any predetermined relationship with the length of a undetwisted portion which is formed adjacent to and upstream of the excessively detwisted portion. In short, an alternatingly twisted yarn of the present invention alternatingly has S-twist portions and Z-twist portions which vary in their lengths and are distributed along the length of the yarn, and there is a positive high correlation between lengths of the S-twist portion and the length of the Z-twist portion adjacent at one end of the corresponding S-twist portion, but there is low correlation between the length of the S-twist portion and the length of the Z-twist portion adjacent at the opposite end of the corresponding S-twist portion.

A model view of a structure of an alternatingly twisted yarn of the present invention is exemplified in FIG. 2. The term "positive high correlation" means that the correlation coefficient which will be defined below is at least 0.7, and the term "low correlation" means that the correlation coefficient is in a range between −0.3 and 0.3. More specifically the following equations (I) and (II) are satisfied.

$$0.7 \leqq \frac{\sum_{i=1}^{n} (\bar{a} - a_i)(\bar{b} - b_i)}{\sqrt{\sum_{i=1}^{n} (\bar{a} - a_i)^2 \times \sum_{i=1}^{n} (\bar{b} - b_i)^2}} \quad \text{(I)}$$

$$-0.3 < \frac{\sum_{i=1}^{n} (\bar{a} - a_{i+1})(\bar{b} - b_i)}{\sqrt{\sum_{i=1}^{n} (\bar{a} - a_{i+1})^2 \times \sum_{i=1}^{n} (\bar{b} - b_i)^2}} < 0.3 \quad \text{(II)}$$

In the present invention the number n used in the above equations (I) and (II) must be between 100 and 600. The symbols "$\bar{a}$" and "$\bar{b}$" means an average of $a_i$ and $b_i$ (wherein $i=1, 2 \ldots n$), respectively.

In a second type of mechanism for forming alternatingly twisted yarn according to the present invention, S-twist portions and Z-twist portions are made relatively long, and the lengths of these portions are randomly varied. More specifically, a process for manufacturing a specially designed alternatingly twisted yarn is characterized in that a thermoplastic synthetic multifilament yarn is subjected to false twisting by means of a false twisting device, and after the yarn is passed through the false twisting device, the yarn is retained in a false twist imparted condition at a location at least adjacent to the false twisting device, and in addition, an over detwisted portion always exists between the false twisting device and a member, which the yarn leaving the false twisting device contacts first.

The above-described term "member which the yarn contacts first" means a member, such as a delivery roller or a yarn guide utilized to change a yarn passage, which is similar to the member which was explained in connection with the first type mechanism and which was used to prevent the downstream transmission of the rotation of the yarn, and the term does not include a member which only contacts a yarn and which substantially does not have the function of preventing the transmission of rotation.

In this type of mechanism according to the present invention, the stoppage of the rotation of the front end of the false twist imparted region is carried out by applying a mechanism wherein the rotational force imparted by the false twisting device cannot be transmitted, and a contacting member is so arranged that an over detwisted portion always exists between the false twisting device and the member, which the yarn leaving the false twisting device contacts first. To carry out the above explained manufacturing mechanism of the present invention, a false twisting texturing machine illustrated in FIG. 1 can be utilized.

FIGS. 7, 8, 9 and 10 are model views illustrating mechanisms for forming alternatingly twisted yarns of the present invention belonging to this type, wherein the changes are illustrated as time elapses from $t_0$ to $t_1$ and $t_2$. In these figures, T denotes a false twisting point; G, a contacting point which the yarn departing from the false twisting device contacts first; P, a boundary between a undetwisted portion and an over detwisted portion; and Q, an untwisting commencing point.

In FIGS. 7, 8, 9 and 10, it is assumed that at time $t_0$ the front end $P_1$ of the false twist imparted region reaches an undetermined point X, located upstream of the point G, where the rotational force imparted by the false twisting device cannot be transmitted downstream to any extent, that the portion located downstream of the point $P_1$ is an over detwisted portion, and that the portion located upstream of the point $P_1$ is a false twist imparted region and is under compact undetwisted condition. The portion located at the point $P_1$ cannot now be rotated, and accordingly, detwisting is commenced at an undetermined point $Q_1$ located between the point T and the point $P_1$.

Thereafter, the points $P_1$ and $Q_1$ are moved downstream at a speed equal to that of the yarn. The detwisted yarn portion changes into an excessively detwisted condition, and torque therein is balanced. The ends of the over detwisted portion are denoted by $P_2$ and $P_3$. The portion between the points $P_1$ and $P_2$ are moved downstream as an undetwisted portion, and the portion between the points $P_2$ and $P_3$ is moved downstream as an over detwisted portion while the length thereof increases.

The point $P_3$ moves downstream as a front end of a new false twist imparted region, and finally it reaches an undetermined point Y where the rotational force imparted by the false twisting device cannot be transmitted downstream (at time $t_2$ in FIGS. 7 through 10), and then a condition similar to that at time $t_0$ takes place, and procedure similar to that described above is repeated.

Figure 7:
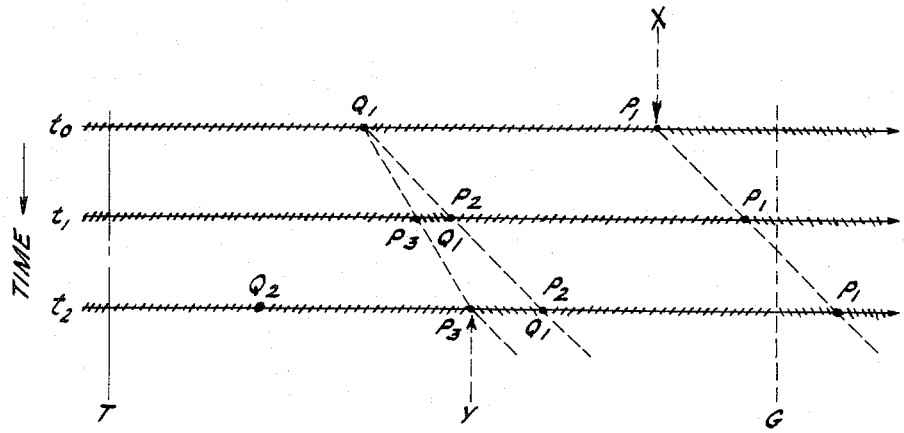

In the case illustrated in FIG. 7, detwisting occurs only at the point $P_3$, and the over detwisted portion between the points $P_2$ and $P_3$ moves downstream while the length thereof is increased upstream. In FIG. 8, the point $P_2$ has a priority for detwisting at the first stage, and the over detwisted portion between the points $P_2$ and $P_3$ moves downstream while the length thereof is increased downstream. However, after the time $t_1$, the detwisting does not occur at the point $P_2$ but at the point $P_3$, i.e., a detwisting wherein the length thereof is increased upstream takes place. In FIG. 9, as time elapses from time $t_0$ to $t_2$, the detwisting is simultaneously advanced downstream and upstream from the point $Q_1$, and accordingly, the length of the over detwisted portion between the points $P_2$ and $P_3$ is increased in both upstream and downstream directions. The front end $P_3$ of the new false twist imparted region moves downstream. In FIG. 10, only at point $P_2$ detwisting occurs after the point $Q_1$ is formed and before the point $Q_2$ is formed. In an actual and commercial texturing process, the above described various procedures for forming over detwisted portions take place at random.

As will be apparent from FIGS. 7 through 9, the number of the over detwisted portions located between T and G is one at times $t_0$ and $t_2$ and is two at time $t_1$. In this type of mechanism according to the present invention, an over detwisted portion always exists between T and G.

As will be obvious from FIGS. 7 through 10, if the position of the contacting member, i.e., the point G, by which the yarn passage is changed, is set at the front end of the false twist imparted region, i.e., a mechanism wherein any over detwisted portion that does not exist temporarily is utilized, the length of the formed undetwisted portion is restricted by the point G, and correspondingly also the length of the over detwisted portions is restricted. Accordingly, long S-twist portions or long Z-twist portions are not formed, and such a location is not preferable.

According to this type of mechanism, a yarn of the present invention can be obtained which has relatively long S-twist portions and Z-twist portions. In addition, since the points X and Y, especially, detwisting commencing points $Q_1$ and $Q_2$, in FIGS. 7 and 10 may be located at random between T and G, (more specifically, the point $Q_1$ may be located at random between X and T and the point $Q_2$ may be located randomly between Y and T), the lengths of the portions can be varied.

A third type mechanism for forming alternatingly twisted yarn of the present invention provides a process for manufacturing a specially designed alternatingly twisted yarn, in which relatively long undetwisted portions and over detwisted portions can be formed and in which, the coefficients of variation, i.e., the variations in the average lengths, of the undetwisted portions and the over detwisted portions can be made relatively equal even when many yarns are simultaneously manufactured by means of a multiplicity of yarn treating units in a machine. Accordingly, this type of mechanism is desirable for a commercial operation. If alternatingly twisted yarn having relatively long S-twist and Z-twist portions is utilized as a warp of a woven fabric in a weaving operation, the S- and Z-twists may not be diminished when the yarn is beaten, in other words, the S- and Z-twists in the yarn will probably remain, and accordingly, the woven fabric produced will have a hand similar to that obtained by a hard twist yarn and patterns with a slight heather-like appearance.

To obtain the above described object, a process for manufacturing an alternatingly twisted yarn of this type of the present invention has the following construction. At a location just downstream of the false twisting device a false twist imparted condition is always retained; and an engaging member is so arranged that when a yarn portion retained in the false twist imparted condition at a location downstream of the false twisting device is advanced to the furthest downstream position (i.e., where the rotation of the yarn is stopped) to where the portion can be located while the yarn is being rotated. There are two cases, i.e., case (1), wherein the furthest downstream end of the yarn in the false twist imparted condition arrives at the engaging member by which downstream transmission of the rotation of the yarn is prevented, and case (2), wherein the end does not arrive at the engaging member. As time elapses, both cases (1) and (2) occur randomly.

An embodiment of this type will now be explained in detail with reference to the accompanying drawings.

A false twisting texturing machine having a construction similar to that illustrated in FIG. 1 can be utilized to carry out the above-described process for manufacturing an alternatingly twisted yarn according to the present invention.

The present mechanism for forming alternatingly twisted yarn comprises the procedure illustrated in FIG. 3 through 6 concerning the first type mechanism and the procedure illustrated in FIGS. 7 through 10 regarding the second type mechanism, and these procedures occur randomly as time elapses. FIG. 11 is a model view illustrating a mechanism of this type from time $t_0$ to $t_1$ . . . as time elapses. In FIG. 11, it is assumed that the front end $P_1$ of the false twist imparted region reaches the point G at time $t_0$. In this case, the portion located downstream of the point $P_1$ is an over detwisted portion, and the portion located upstream of the point $P_1$ is a false twist imparted region and is in an under undetwisted condition. A rotational force is applied at the point T. However, the point $P_1$ now located at point G cannot rotate, and accordingly, detwisting is commenced at an undetermined point $Q_1$ located between the points T and $P_1$.

Thereafter, the points $P_1$ and $Q_1$ advance downstream at a speed equal to that of the yarn. A yarn portion which has been detwisted is changed to an over detwisted condition, and the torque therein is balanced, and the ends of the over detwisted portion are designated by $P_2$ and $P_3$. The portion between the points $P_1$ and $P_2$ is a undetwisted portion and moves downstream, and the portion between the points $P_2$ and $P_3$ is an over detwisted portion and moves downstream while the length thereof is increased.

The point $P_3$ moves downstream as a new front end of a new false twist imparted region, and finally arrives at an undetermined point X where the rotation cannot be transmitted (at time $t_2$) so that a condition wherein the rotation cannot be transmitted similar to that at time $t_0$ occurs. Accordingly, a new detwisting point $Q_2$ which is undetermined is formed, and then a procedure similar to that described above repeats.

In an actual process, there are various modes wherein an over detwisted portion between the points $P_2$ and $P_3$ moves downstream while the length thereof is increased, for example, modes illustrated in FIGS. 3 through 10 which were explained above, and these various modes take place alternately and in combination with the same yarn treating unit.

In the present type of mechanism for forming an alternating twisted yarn of the present invention, since the detwisting point Q is generated relatively randomly at a relatively uniform probability at an undetermined location between the point T and the point G or X, and since the location of the point X is undetermined, the distributions of the obtained undetwisted portions and the over detwisted portions form a rectangular distribution rather than a normal distribution, and have a large variation. Therefore, this mechanism is suitable to obtain an alternatingly twisted yarn by which a woven or knitted fabric having uniformly distributed patterns with a heather-like appearance and the hand associated therewith can be manufactured.

When this type of mechanism of the present invention is actually utilized, if the furthest downstream end of a yarn portion in a false twist imparted condition moving downstream always engages with an engaging member and the rotation of the end is stopped, the length of the undetwisted portion formed there is restricted, and at the same time the length of the corresponding over detwisted portion is also restricted. Accordingly, relatively long undetwisted portions and over detwisted portions cannot be formed, and therefore the above-described condition is not desirable. Contrary to this, where the rotation of the front end always stops before the front end engages with the engaging member, i.e., the location where the front end $P_3$ of the false twist imparted region is entirely free, the average lengths of the undetwisted portions and the over detwisted portions may result in uneveness between the treating units when yarns are treated at a multiplicity of treating units. Therefore, this condition is also undesirable. It is very important that the location where the engaging member is disposed is appropriately adjusted. In conclusion, it is preferable for an actual and commercial operation that when a front end $P_3$ of a false twist imparted region abnormally advances beyond the length usual for a normal treating operation so that an excessive length which is longer than a desired length is formed, the front end is permitted to reach the point G so that generation of a new detwisting point Q is enforced; and that in such a manner the upper limit of the undetwisted portion is adjusted so that uneveness between the operational units can be reduced.

In all the embodiments of the present invention, it is preferable that a specially designed alternating twist yarn of the present invention has S-twist portions and Z-twist portions, the length of which are randomly distributed, and that the coefficient of variation, i.e., the variation of the lengths, is at least 50%. In this case, if the lengths of S-twist portions and/or Z-twist portions are extremely randomly distributed, a woven fabric having patterns with a uniformly distributed heather-like appearance can be obtained.

Based on the knowledge obtained in development of the present invention, it is preferable that the following requirements and conditions be satisfied.

(1) The operation of a false twisting system comprising a supply means, a heating means, a false twisting means and delivery means is not substantially varied while it is being operated.

(2) The obtained yarn is in hard twist conditon and has a twist contraction of between several and about 20%, and accordingly, overfeed condition corresponding to the twist contraction and/or a supply yarn having a sufficient elongation should be utilized.

(3) When the undetwisted portion in the yarn is exposed to a detwisting operation, the entire twist density of the said portion is not gradually decreased but only a part of said portion is detwisted, and the portion which is not detwisted substantially retains its original twist density and gradually becomes short, whereby the detwisted portion is successively changed into an over dewisted portion. Therefore, this property should fully be utilized.

(4) Since the twist density in the false twisting remains as that in the undetwisted portions, it is preferable that the twist number of the false twisting be high. However, if the false twist number is excessively high, double twists may be caused and result in the twists transmitted across the false twisting device being varied or the twisting force of the false twisting device becoming almost the holding limit or exceeding the limit so that the yarn is discontinuously twisted, and accordingly, non-twist portions may be created. It is preferable that the false twist number is set at a value relatively lower than that of usual false twisting.

(5) Ballooning should be as small as possible during the yarn treating operation, and it is preferable that the treatment be carried out under a stationary ballooning condition where ballooning cannot visually be recognized.

(6) It is preferable that the tension in the yarn located downstream of the false twisting device be as low as possible, taking the construction of the false twisting device and the engaging member, and the treatment conditions into consideration so that the resistance from the false twisting device and the engaging member can be small. Especially the engaging member should not be used if possible, and if such a member is indispensable, it is preferable that a rotatable member be used instead of the fixed member. Furthermore, if such a fixed member is indispensable, the total contacting angles, over which a yarn wraps around the fixed member, should be at most 30 degrees.

(7) It is necessary to keep the types and the constructions of the false twisting device and the yarn guides, and the yarn treating conditions in mind, so that yarn is not subjected to a high abrasion or a change of yarn passage which has a large curvature.

The requirements and conditions which are desirable to carry out a method of the present invention are not limited to the above-mentioned seven items. However, when a thermoplastic multifilament yarn is false twisted, if the above-mentioned seven items are satisfied, the object of the present invention can be achieved.

EXAMPLES

Several examples of the present invention will now be explained.

EXAMPLE 1

Polyethylene terephthalate was met spun and was taken up at a speed of 3000 m/min so that an undrawn multifilament yarn of 126 denier/36 filament was obtained. The natural draw ratio of the undrawn multifilament yarn was 1.62. The yarn was drawn at a draw ratio of 1.4 and was false twisted at the drawing zone, a part of the false twist imparted region in the yarn was heated by means of plate heater which was heated at a temperature of 230° C.

An outer friction type false twisting device described in Japanese Patent Laid-open No. 69343/75 was utilized but a guide just downstream of the false twisting device was removed. The twist density during the false twisting was $28000/\sqrt{D}$ Turn/m, and D was 90 denier, and accordingly, the twist density was about 2951 Turn/m.

The undetwisted portions of the obtained yarn had a twist density of 2900 Turn/m and a compact twist yarn structure. The over detwisted portion had a twist density of 1300 Turn/m and had a bulky twist yarn structure wherein crimps of the false twisting appeared in individual constituent filaments.

In this yarn, the ratio of the lengths occupied by the undetwisted portions to the entire length of the yarn was 31%. In addition, the sum of the squares of the length (mm) of the undetwisted portions was 5200 per one meter of the yarn.

A plain weave fabric, the warp density of which was 73/inch and the weft density of which was 70/inch, was manufactured by utilizing this yarn, and the fabric had a hand similar to that obtained by a hard twist yarn and was provided with patterns with a slight heather-like appearance.

This yarn did not have large deformation which would diminish manufacturing efficiency in producing the fabric, and by visual inspection, clear dye speck along the yarn or strong cohesion was not observed.

The twist densities of the undetwisted portions and the over detwisted portions were determined as follows in this Example and also in the other Examples. First certain lengths of the compact undetwisted portions and the over detwisted portions were sampled, and the twists therein were counted, and then based on the lengths and the obtained counts, twist numbers per one meter were calculated.

EXAMPLE 2

A polyethylene terephthalate multifilament yarn melt spun in a manner similar to that carried out in Example 1 was drawn and false twisted by means of a false twisting texturing machine being the same as that used in Example 1. In this case, various twist densities during the false twisting were set in a range between 1800 and 3200 Turn/m. In all the cases, undetwisted portions were generated, and the twist densities were almost the same as those of the false twisting. More specifically, the yarns alternatingly had (1) undetwisted portions, in which crimp configuration in the filaments was consistent with the twist structure of the yarn and which had a compact twist yarn structure; and (2) over detwisted portions, which had a bulky twist yarn structure having twists in a direction opposite to the compact twist yarn structure and in which crimp configuration of the filaments appeared. The lengths of both portions were randomly distributed, and almost no non-twisted portions which did not belong to either the compact or bulky twist structures were obtained.

The obtained yarns had a thickness of about 90 denier and were used as wefts at a weft density of 85/inch to manufacture plain weave fabrics. In this case, a polyester multifilament yarn of 50 denier/24 filament was used as a warp at a warp density of 135/inch. Hand and appearance of the woven fabrics were evaluated. All the fabrics had a hand similar to that obtained by a true twist yarn. The relationship between the twist densities of the undetwisted portions and the patterns with a heather like appearance in the fabrics were as follows. When the twist density of undetwisted portion was 2000 Turn/m, the patterns were unclear. When the twist density of the undetwisted portion was 2400 Turn/m, the patterns were clear. When the twist density was of an intermediate value, i.e., 2200 Turn/m, clearness of the patterns was slightly insufficient. As a result, it was confirmed that when the twist density of the undetwisted portions is equal to or larger than 2200 Turn/m, i.e., $17500\sqrt{\rho/D}$, a better heather-like appearance can be obtained.

The yarn of the present invention wherein the twist density of the undetwisted portions was 2400 Turn/m was obtained through the false twisting wherein the twist density was set at 2430 Turn/m.

The construction of this yarn was further investigated in detail, and it was found that the ratio of the lengths of the compact twist yarn structure to the entire yarn length was 17% and that the sum of the squares of the lengths (mm) was 3400 per one meter in length.

This yarn was not deformed to such an extent that it became unsuitable for manufacturing woven fabric, even when the yarn was subjected to tension. Under visual examination, no clear dye speck or cohesion along the yarn was observed.

EXAMPLE 3

Polyethylene terephthalate was melt spun and was taken up at a speed of 3000 m/min so that an undrawn multifilament yarn of 137 denier/36 filament was obtained.

The yarn was drawn at a draw ratio of 1.4 and was false twisted at the drawing zone, the heating temperature was 235° C. and the number of the false twists was 3200 Turn/m. An outer friction type false twisting device was utilized.

During the operation, 300 photographs were taken so that the conditions of a part of the false twisting device and the 5 mm of yarn located downstream of the false twisting device could be observed. From these photographs, it was confirmed that the yarn located just downstream of the false twisting device was all in undetwisted condition. Four of the 300 photographs showed that the yarn partly had over detwisted portions in the region of 5 mm length.

The yarn alternatingly had (1) undetwisted portions, the twist density of which was 3100 Turn/m and the average length of which was 37 mm, and (2) over detwisted portion, the twist density of which was 1800 Turn/m and the average length of which was 63 mm. Almost no non-twist portions were formed. The yarn was used to manufacture a woven fabric, which had a hand similar to that of a hard twist yarn fabric and different from that obtained by a conventional alternatingly twisted yarn and which provided patterns with a heather like appearance.

EXAMPLE 4

Polyethylene terephthalate was melt spun and was taken up at a speed of 3000 m/min so that a multifilament yarn of 137 denier/36 filament was obtained.

The yarn was drawn at a draw ratio of 1.4 and was false twisted at the drawing zone, the heating temperature was 238° C. and the number of the false twists was 3200 Turn/m. The heating device was a contacting plate, the length of which was 1.5 m and the radius of curvature of which was 30 m, having a semi-circular groove, the radius of which was 2 mm and which extended along the yarn passage. The false twisting device was of an outer surface friction type provided with three shafts. The distance between the heating device and the false twisting device was 65 cm and a second contacting plate, the length of which was 50 cm, the radius of curvature of which was 10 m, was disposed therebetween and was maintained at a temperature of 40° C. The distance between the false twisting device and the delivery device was 40 cm, and the delivery speed was 520 m/min.

Furthermore, a rotatable guide having a diameter of 10 mm was disposed at a position 20 mm downstream of the false twisting device, and the yarn was wrapped therearound.

A yarn alternatingly having undetwisted portions and over detwisted portions was produced. The twist density of the undetwisted portions was 3000 Turn/m, the average length thereof was 8.3 mm, the maximum length thereof was 20 mm, and the ratio of the lengths thereof to the entire yarn length was 36.5%. The twist density of the over detwisted portions was 1720 Turn/m, the average length thereof was 14.4 mm, the maximum length thereof was 32 mm, and the ratio of the lengths thereof to the entire yarn length was 63.5%.

The correlation coefficient between the lengths of the undetwisted portions ($a_i$) and the lengths of the over detwisted portions ($b_i$) located adjacent to and upstream thereof during the treating operation, which coefficient was calculated by the right term in equation (I), was 0.79. Least squares method was applied to ($a_i$, $b_i$) and the following equation was obtained.

$$b = 1.50a + 2.0 \text{ (mm)}$$

This equation means that a is approximately proportional to b, and that, in addition, a constant term "2.0 mm" is included. The contant term corresponds to a yarn length which was moved after the front end of the false twist imparted region arrived at the point G and before the detwisting point was generated.

The correlation coefficient between the lengths of the undetwisted portions ($a_i$) and the lengths of the over detwisted portions ($b_i$) located adjacent thereto and downstream thereof during the treating operation was 0.14.

If the distribution of the lengths ($a_i$) of the undertwisted portions is shown in a histogram with a width of 1 mm, the frequency between zero and 12.5 mm was almost constant, the frequency between 12.5 and 20 was gradually and linearly discussed as the length increased, and the length more than 20 mm was zero. The coefficient of variation of $a_i$ was 60.0%.

The outer diameter of the undetwisted portions was approximately uniform and was 100 μm, and the outer diameter of the over detwisted portions was 130 μm in their average.

The yarn obtained through the above-explained process was further heat treated and then a woven fabric (structure: plain weave fabric; warp density: 87/inch; and weft density: 84/inch) was manufactured. In the woven fabric, the undetwisted portions were transparent and formed an ornamental effect in a combination of the warps and wefts, and the patterns were visually uniform.

Since the fabric was hard due to the cohesion in the yarn and due to the hard twist effect, it was treated by means of caustic soda so that its weight was decreased by 23%, and a hand similar to that of cotton voile was obtained.

The fabric had an ornamental effect, which was superior to that obtained by a conventional yarn, and had a superior hand.

EXAMPLE 5

The Example 4, the rotational guide disposed downstream of the false twisting device and the engagement of the yarn therewith were changed as follows, and the other conditions were the same as those in Example 4.

Test No. 1: The wrapping and contacting angle between the rotational guide and the yarn was set at 45°.

Test No. 2: A second rotational guide similar to the rotational guide was disposed 14 mm downstream from the first rotational guide so that the yarn was passed along a zigzag (S-line) passage, and the contacting angle of each guide was 45°.

The yarns were not substantially different from those of Example 4.

It was confirmed that the contacting angle of 45° in test No. 1 was sufficient to prevent the rotation of the yarn from being transmitted.

The second rotational guide in test No. 2 did not appear to contribute to preventing the rotation of the yarn. However, it served to change the yarn passage. Accordingly, such a rotational guide may be required in an actual process.

When the method of test No. 2, wherein the yarn was wrapped around the two rotational guides along an S-line and was fed in the desired direction, was compared with the method of Example 4, wherein the yarn was wrapped around a rotational guide for 360°, the operability of the former method was superior to that of the latter method.

EXAMPLE 6

In Example 4, the location of the rotational guide is moved to a position 30 mm from and downstream of the false twisting device, and the other conditions were the same as those in Example 4.

The twist density of the undetwisted portions the yarn produced was 3000 Turn/m, the average length thereof was 12.4 mm, and the maximum length thereof was 30 mm, and the ratio of the lengths thereof to the entire length of the yarn was 37.6%.

The twist density of the over detwisted portions in the yarn produced was 1810 Turn/m, the average length thereof was 20.6 mm, the maximum length thereof was 47 mm, and the ratio of the lengths thereof to the entire length of the yarn was 62.4%.

EXAMPLE 7

In Example 4, the rotational guide disposed at a position along 20 mm from and downstream of the false twisting device was replaced by a fixed guide made of titanium oxide ceramic and having a diameter of 8 mm, and the contacting angle of the yarn was 45°. The other conditions were the same as those in Example 4.

A yarn approximately similar to that of Example 4 was produced. More specifically, the over detwisted portions were slightly longer than those of Example 4, and the twist density thereof was a little bit lower than that of Example 4. During the false twisting, 100 photographs of the yarn running between a location just downstream of the false twisting device and a location 5 mm downstream from the false twisting device was taken utilizing a stroboscope and then enlarged. In all 100 photographs, the yarn located just downstream from the false twisting device was in undetwisted condition. There were six photographs illustrating that over detwisted portions of 5 mm in length were included in the yarn.

EXAMPLE 8

False twisting was carried out under the same conditions as those in Example 4 except that no member engaging with the yarn was additionally disposed.

The yarn produced alternatingly had undetwisted portions and over detwisted portions. The twist density of the undetwisted portions was 3000 Turn/m, the average length thereof was 70 mm, the maximum length thereof was 200 mm, the ratio of the lengths thereof to the entire length of the yarn was 39.4%, and the outer diameter thereof was approximately 100 μm. The twist density of the over detwisted portions was 1950 Turn/m, the average length was 107.5 mm, the ratio of the lengths thereof to the entire yarn length was 60.6%, and the outer diameter thereof was 128 μm.

The yarn obtained through the above explained process was subjected to a heat treatment by passing through a heating zone, which was located downstream from the above-explained process, which was heated at a temperature of 237° C. and the length of which was 1.2 m. The yarn was taken up at a speed of 520 m/min so that the torque of the yarn was decreased and the tensile strength thereof was increased. Thereafter, a woven fabric (structure: plain weave fabric; warp density: 85/inch; and weft density: 82/inch) was produced. In the fabric, the undetwisted portions were transparent-like, and several undetwisted portions were contiguously arrayed in the fabric. The undetwisted portions in the wefts and the warp form special patterns with a heather-like appearance on the fabric. Although the fabric was partially non-uniform and uneven, when it was visually observed as a whole, it was uniform and had a splendid ornamental appearance.

Since the fabric was hard due to the cohesion and hard twist effects in the yarn, it was treated with caustic soda so that its weight was decreased by 22%. A novel and comfortable hand similar to crepe georgette and voile utilizing sea island cotton was obtained.

In the above-explained process, a traverser was disposed at a position 50 mm upstream from the take up device so that yarn engaging position in the take up device was varied and so that the take up device was protected. This traverser almost had no effect on the formation of the yarn.

EXAMPLE 9

In Example 8, the take up device positioned 40 cm downstream from the false twisting device along the rotational axis thereof was further displaced in a perpendicular direction by 5 cm, so that the yarn passing through the false twisting device was introduced along the rotational axis and was wrapped around the first rotational guide for 45°, and then was wrapped around the second rotational guide for 45° and introduced in the rotational axis, whereby the yarn was engaged with the take up device. The other conditions were the same as those in Example 4.

The distance L (mm), which was equal to the yarn passage between the false twisting device and the first rotational guide, was varied between 7 and 300 mm. The relationships between the distance L and the average lengths and the maximum lengths of the undetwisted portions in the yarns were researched.

The average lengths were approximately proportional to the distance L if L was between 7 and 100 mm, and the average length was 40.5 mm for L equal to 100 mm. When the distance L was between 100 and 200 mm, the degree of increase of the average length due to the increase of the distance L was gradually decreased, and the average length was almost constant, i.e., about 70 mm for the distance L of between 200 and 300 mm.

The maximum length was approximately equal to L if L was between 7 and 200 mm. In a range wherein L was between 200 and 300 mm, the maximum length wass about 200 mm and almost did not vary.

From these results, it was confirmed that almost all the front ends of the false twist imparted regions, which ends were repeatedly generated as time elapsed, arrived at the first rotational guide when L was equal to or less than 100 mm; that when L exceeded 200 mm, almost none of the front ends reached the first rotational guide; and that if L was between 100 and 200 mm, the case wherein the ends arrived at the guide and the cases wherein the ends did not arrive randomly occurred.

From the above-decribed results, it was understood that some members, such as a take up device, a guide which changes yarn passage so as to introduce it to the take up device, which need to be engaged with a yarn at a location downstream of a false twisting device should be separated from the false twisting device by a distance of at least 200 mm. This is because, the maximum arrival distance of each end of a false twist imparted region is 200 mm in a direction downstream of the false twisting device.

EXAMPLE 10

In Example 9, in addition to the temperature of 237° C. for the false twisting machine, 235° and 240° were utilized, and the maximum arrival distances of the front ends of false twist imparted region were measured. When the temperature was 235° C., the distance was 100 mm; and at 240° C., 250 mm.

EXAMPLE 11

In Example 8, under four conditions, wherein between a location 200 mm downstream from the false twisting device and the take up device, one fixed guide, two and three fixed guides, and one fixed guide and one rotational guide were disposed, the yarn engaging conditions were researched.

As a result, it was confirmed that whether or not a rotational guide is disposed or wrapped at a contacting angle there was almost no effect on the formation of the yarn, and that if the total wrapped contacting angle about a fixed guide exceeds 30°, the ratio of the lengths of undetwisted portions to the entire yarn length was decreased.

It was also confirmed that when it is necessary to change a yarn passage between a false twisting device and a take up device, the fixed guide can be used if the turning angle is equal to or less than 30°; if the turning angle is more than 30°, the wrapped contacting angle may be less than 30° by utilizing a rotatable member.

EXAMPLE 12

According to a false twisting method which was the same as that of Example 8 except that the temperature of the heating plate was 240° C., a polyethylene terephthalate multifilament yarn was treated.

The yarn produced had undetwisted portions and over detwisted portions which portions were alternatingly distributed.

The average lengths of the undetwisted portions, which were calculated based on the operating units, were between 70 and 92 mm. These yarns were used as a weft yarn to form a plain weave fabric (warp yarn: a multifilament yarn of 50 denier/24 filament; warp density: 150/inch; and weft density: 85/inch). A clear difference was seen between the part of the fabric wherein the yarn having an average length of undetwisted portions of 70 mm was used and the part of the fabric wherein the yarn having an average length undetwisted portions of 92 mm was used.

Next a rotatable guide having a diameter of 10 mm was disposed at a location 160 mm downstream from the false twisting device, and the yarn was wrapped around this guide so that treatment could be carried out. As a result, the average length of the undetwisted portions which had been 70 mm was changed to 62 mm, and similarly 92 mm was changed to 68 mm. These yarns were woven to form a plain weave fabric in which no substantial difference was observed.

The heating temperature in the treating unit, wherein the yarn having the longest average length of undetwisted portions was manufactured, was 240° C., and contrary to this the heating temperature in the unit, wherein the yarn with the shortest average length was manufactured, was 237° C.

After the setting of the heating device was changed to 243° C., a yarn was treated without utilizing the rotatable guide, and a yarn with an average length of undetwisted portions of 91 mm was produced in the yarn treating unit wherein the yarn having the average length of the undetwisted portions of 71 mm had been manufactured.

From the above-explained tests, it was confirmed the variation in the average lengths of undetwisted portions between yarn treating units was mainly based on the difference in the heating temperatures, and that the variation between the yarn treating units could be reduced if a rotatable guide was utilized.

Utilizing a single yarn treating unit and a rotatable guide, for the two heating temperatures, i.e., 237° C. and 240° C., the distance L (mm) which was measured along the yarn passage between the false twisting device and the rotatable guide was variously changed within a range of between 7 and 300 mm, and the relationship between the distance L, and the average length and the maximum length of undetwisted portions in the yarn obtained by the corresponding distance L was observed.

When the heating temperature was 237° C. (240° C.), the average lengths were approximately proportional to the distance L in a range wherein the distance L was 7 and 100 mm (7 and 120 mm), i.e., 40.5 mm (51 mm) at L of 100 mm (120 mm). In a range wherein the distance L was between 100 mm (120 mm) and 200 mm (250 mm), the degree of the increase of the average length was gradually decreased as the distance L increased, and when the distance L exceeded 200 mm (250 mm) until it reached 300 mm, the average length of about 70 mm (92 mm) was almost unchanged.

Contrary to this, the maximum length was approximately equal to L when the distance L was in a range between 7 and 200 mm (7 and 250 mm), and it was almost 200 mm (250 mm) and unchanged when the distance L was in a range of between 200 and 300 mm (250 and 300 mm).

From this observation, it was confirmed that front ends of the false twist imparted region, which ends were repeatedly generated as time elapsed, almost arrived at the rotatable guide when the distance L was equal to or less than 100 mm (120 mm); that they almost did not arrive at the rotatable guide when the distance L was larger than 200 mm (250 mm); and that when the distance L was between 100 and 200 mm (120 and 250 mm), the times wherein they arrived at the guide and the times wherein they did not arrive at the guide were mixed as time elapsed.

Please note that in this Example, the figures enclosed by parentheses indicate the conditions and data when a heating temperature of 240° was used.

We claim:

1. A process for manufacturing alternatingly twisted yarn, wherein a thermoplastic synthetic multifilament yarn is subjected to false twisting along a substantially stationary path in a manner to avoid ballooning, and the yarn is drawn under a draw ratio equal to or less than the natural draw ratio, by means of a false twisting device, wherein a yarn contacting member is disposed at a location downstream of said false twisting device, whereby a front end of false twisted region in said yarn is prevented from being transmitted across said yarn contacting member, wherein an over detwisted portion is generated in said yarn located between said false twisting device and said yarn contacting member, and wherein even after said yarn is passed through said false twisting device said yarn is retained in a false twisted condition at a location at least adjacent to said false twisting device.

2. A process for manufacturing alternatingly twisted yarn according to claim 1, wherein the number of said excessively untwisted portion, which is generated between said false twisting device and said yarn contacting member, is always at the most one.

3. A process for manufacturing alternatingly twisted yarn according to claim 1, wherein portions in which the number of said over detwisted portion is at most one, and portions in which said number is more than one, randomly occur as time passes.

4. A process for manufacturing alternatingly twisted yarn according to claim 1, wherein said yarn contacting member is a rotatable member.

5. A process for manufacturing alternatingly twisted yarn according to claim 1, wherein said yarn contacting member is so arranged that yarn passage is deflected while contacting therewith along a zigzag passage.

6. A process for manufacturing alternatingly twisted yarn according to claim 1, wherein no additional means which contacts with said yarn is disposed between said false twisting device and said yarn contacting member.

7. A process for manufacturing alternatingly twisted yarn according to claim 1, wherein an over detwisted portion always exists between said false twisting device and said member, with which said yarn leaving from said false twisting device contacts first.

8. A process for manufacturing alternatingly twisted yarn according to claim 1, wherein a yarn passage located upstream of said false twisting device, at least adjacent to said false twisting device, is substantially stationary.

9. A process for manufacturing alternatingly twisted yarn according to claim 1, wherein a passage of said yarn, engaging with said false twisting device, is substantially stationary.

10. A process for manufacturing alternatingly twisted yarn according to claim 1, wherein the total contacting angle of said yarn between said false twisting device and a take up device is at most 30 degrees.

11. A process for manufacturing alternatingly twisted yarn according to claim 1, wherein said false twisting device is of a friction type.

12. A process for manufacturing alternatingly twisted yarn according to claim 11, wherein said friction type false twisting device is provided with a friction surface, which is moved in a direction intersecting with a yarn moving direction at an acute angle.

13. A process for manufacturing alternatingly twisted yarn according to claim 1, wherein filaments constituting said yarn are partially cohered to each other by means of heating while they are false twisted.

14. A process for manufacturing alternatingly twisted yarn according to claim 1, wherein the ratio of the take up speed of said yarn while being false twisted to the feed speed of said yarn is lower than natural draw ratio of a supplied yarn.

15. A process for manufacturing alternatingly twisted yarn according to claim 14 wherein said supplied yarn is an undrawn yarn.

16. A process for manufacturing alternatingly twisted yarn according to claim 1, wherein a polyester yarn is used as a supply yarn.

* * * * *